US006481392B1

(12) United States Patent
Etemad

(10) Patent No.: US 6,481,392 B1
(45) Date of Patent: Nov. 19, 2002

(54) INTERNAL COMBUSTION ENGINE

(75) Inventor: Sassan Etemad, Västra Frölunda (SE)

(73) Assignee: Volvo Personvagner AB, Gothenburg (SE)

( * ) Notice: Subject to any disclaimer, the term of this patent is extended or adjusted under 35 U.S.C. 154(b) by 0 days.

(21) Appl. No.: 09/711,154

(22) Filed: Nov. 9, 2000

(30) Foreign Application Priority Data

Nov. 12, 1999 (SE) ..... 9904101

(51) Int. Cl.[7] ..... F02B 75/18
(52) U.S. Cl. ..... 123/41.74; 123/41.79
(58) Field of Search ..... 123/41.74, 41.79, 123/41.82 R

(56) References Cited

U.S. PATENT DOCUMENTS

| | | | | |
|---|---|---|---|---|
| 2,710,602 A | * | 6/1955 | Maybach | 123/41.82 R |
| 4,569,313 A | * | 2/1986 | Nobu | 123/41.74 |
| 4,759,317 A | * | 7/1988 | Ampferer | 123/41.74 |
| 5,558,048 A | | 9/1996 | Suzuki et al. | |

FOREIGN PATENT DOCUMENTS

| | | |
|---|---|---|
| EP | 0208416 A2 | 1/1987 |
| EP | 0466551 A1 | 1/1992 |
| EP | 0512600 A1 | 11/1992 |
| EP | 0870918 A1 | 10/1998 |
| SE | 509077 C2 | 11/1998 |

* cited by examiner

*Primary Examiner*—Noah P. Kamen
(74) *Attorney, Agent, or Firm*—Howrey Simon Arnold & White LLP

(57) ABSTRACT

The invention relates to an internal combustion engine comprising a cylinder block with at least one cylinder and at least one intake and exhaust valve per cylinder. A cooling system includes an inlet opening that is formed in the cylinder block and leads to a first coolant space in the cylinder block. At least one restriction element is arranged in the first coolant space. A second coolant space is arranged in a cylinder head and inlet ports are arranged in the cylinder head which connect the first and second coolant spaces to one another. The inlet ports are principally situated on an exhaust side of the cylinder head. Outlet ports are arranged in the cylinder head and connect the first and second coolant space to one another. The outlet ports are principally situated on an intake side of the cylinder head. An outlet opening formed in the cylinder block has a connection to the first coolant space.

8 Claims, 5 Drawing Sheets

INTERNAL COMBUSTION ENGINE

RELATED PATENT APPLICATIONS

This patent application claims priority to Swedish Patent Application No. 9904101-4 filed Nov. 12, 1999.

TECHNICAL FIELD

The present invention relates to an internal combustion engine including a cylinder block with at least one cylinder and at least one intake and exhaust valve per cylinder. A cooling system is included that has an inlet opening formed in the cylinder block and leads to a first coolant space in the cylinder block. At least one restriction element is arranged in the first coolant space and a second coolant space is arranged in a cylinder head. Inlet ports are arranged in the cylinder head which connect the first and second coolant spaces to one another and are principally situated on an exhaust side of the cylinder head.

BACKGROUND OF THE INVENTION

An internal combustion engine with a cooling system is known from U.S. Pat. No. 5,558,048. The coolant is introduced into the cylinder block and is conveyed to the intake side of the cylinder block by means of a restriction element. The coolant bypasses the cylinders in the cylinder block and passes on to the cylinder head by way of an opening. The coolant is also allowed, however, to flow through slits, which are formed between respective cylinders. Each slit has a connection to a coolant port which opens out between respective cylinders in the cylinder head.

In internal combustion engines with a cooling system of this type, the cooling of the area between the exhaust valve seats for each cylinder in the cylinder head is often deficient because the geometry of the cylinder head is often designed so that the rate of flow of the coolant is low in the area between the exhaust valve seats.

The document SE-C2-509,077 shows an internal combustion engine that is provided with a cooling system and which is designed so that the coolant's rate of flow is high in the area between the exhaust valves seats. This is achieved by coolant ports that open out into the cylinder head in an area between the exhaust valve seats for each cylinder.

Some engines are provided with a fuel injector that extends directly into the cylinder. Thus the fuel will be injected directly into the cylinder. The area around the injector becomes very hot, which means that electronics arranged in the injector may be damaged by the large amount of heat developed.

Neither of the above-mentioned documents discloses an internal combustion engine with a cooling system that is adapted for cooling a fuel injector.

In view of the above described deficiencies associated with conventionally designed internal combustion engines, the present invention has been developed. These enhancements and benefits are described in greater detail hereinbelow with respect to several alternative embodiments of the present invention.

SUMMARY OF THE INVENTION

The present invention in its several disclosed embodiments alleviates the drawbacks described above with respect to conventionally designed internal combustion engines and incorporates several additional beneficial features.

One benefit of the present invention is the achievement of satisfactory cooling of a fuel injector that is arranged on an intake side of the internal combustion engine. Another is the achievement of a substantially even coolant flow around each cylinder of the engine that creates a satisfactory and even cooling of cylinders and cylinder liners and thereby obtains substantially the same optimum combustion temperature in each cylinder. Still further, the invention counteracts cylinder and cylinder liner deformation.

According to the invention, these and other objects are achieved by means of outlet ports arranged in the cylinder head which connect the first and second coolant spaces to one another. The outlet ports are principally situated on an intake side of the cylinder head. Further, an outlet opening is formed in the cylinder block which has a connection to the first coolant space.

An internal combustion engine with such a cooling system creates satisfactory and even cooling of the cylinders and the cylinder liners. At the same time, a satisfactory cooling of the engine fuel injector is obtained since the outlet ports are situated on the intake side of the engine. Among other things, this facilitates stoichiometric combustion at high load.

BRIEF DESCRIPTION OF THE DRAWINGS

The invention will now be described in greater detail in the following way, by example only, and with reference to the attached drawings, in which.

DETAILED DESCRIPTION OF THE INVENTION

As required, detailed embodiments of the present invention are disclosed herein. However, it is to be understood that the disclosed embodiments are merely exemplary of the invention that may be embodied in various and alternative forms. The figures are not necessarily to scale, some features may be exaggerated or minimized to show details of particular components or processes. Therefore, specific structural and functional details disclosed herein are not to be interpreted as limiting, but merely as a basis for the claims and as a representative basis for teaching one skilled in the art to variously employ the present invention.

Figure 1A:
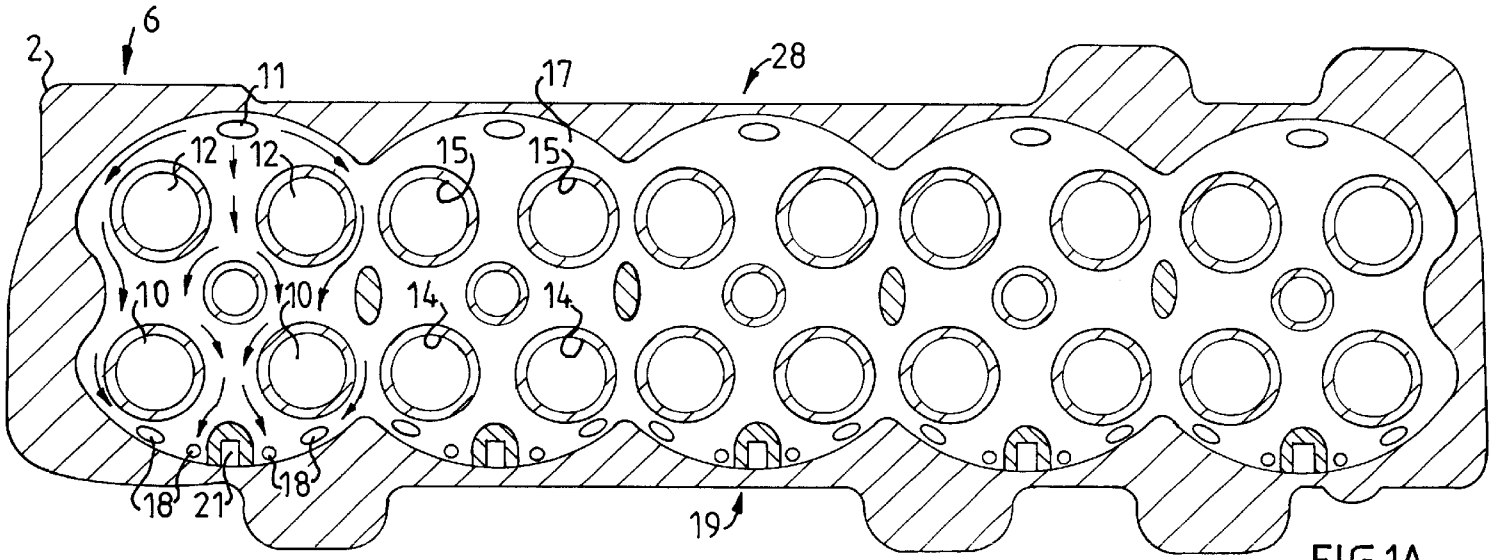
FIG. 1*a* shows a cylinder head according to a first embodiment of the present invention.
Figure 2:
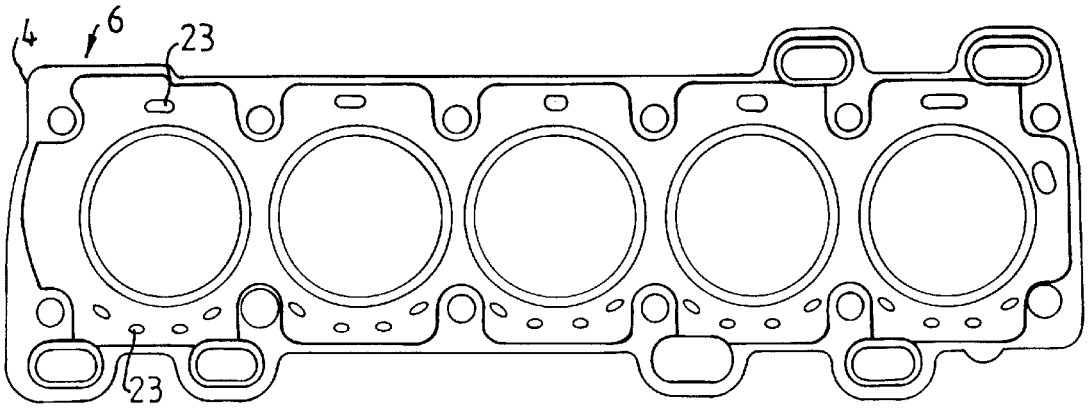
FIG. 2 shows a cylinder head gasket according to the present invention.
Figure 3:
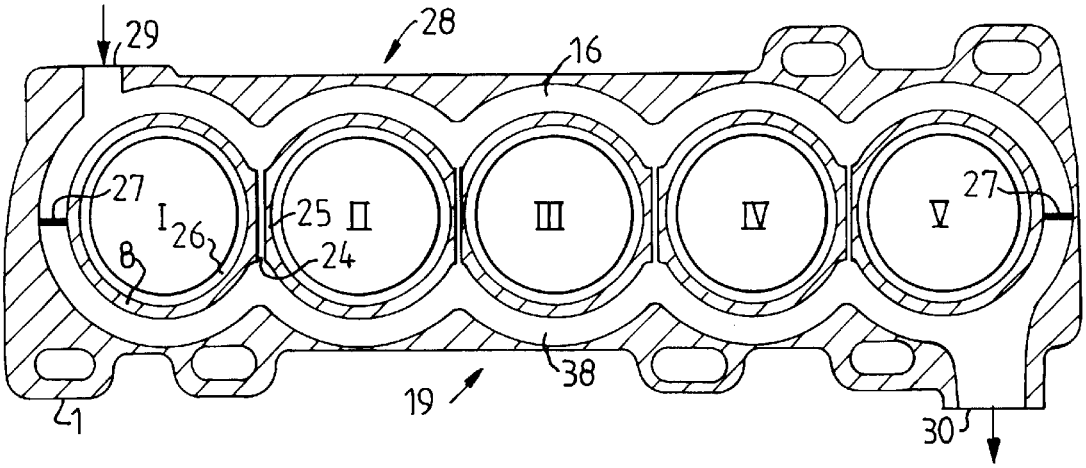
FIG. 3 shows a cylinder block according to the present invention.

FIG. 1*a* shows a cylinder head 2 according to a first example of an embodiment of the invention. The cylinder head 2 according to this first example is adapted to a cylinder block 1 which is shown in FIG. 3. A cylinder head gasket 4 is shown in FIG. 2 and is arranged between the cylinder head 2 and the cylinder block 1. The cylinder head 2, the cylinder block 1 and the cylinder head gasket 4 form components in an internal combustion engine 6. The internal combustion engine 6, according to the example of an embodiment shown, is designed with five cylinders 8 in-line. The cylinders 8 are numbered as I–V in FIGS. 3 and 4; cylinder I is situated on the extreme left and cylinder V is situated on the extreme right in FIG. 3. Each cylinder 8 is provided with two intake valves 10 and two exhaust valves 12 which interact with the respective valves seats 14, 15 in the cylinder head 2. Between the exhaust valve seats 15 for each cylinder 8, an inlet port 11 opens out which convey coolant 13 from a first coolant space is in the cylinder block 1 to a second coolant space 17 in the cylinder head 2.

Coolant 13 flows from the inlet ports 11 towards outlet ports 18 which are arranged in the cylinder head 2 and convey the coolant 13 from the second coolant space 17 in the cylinder head 2 back to an intake side 19 of the first coolant space 16 in the cylinder block 1. The outlet ports 18 are arranged on the intake side 19 of the cylinder head 2. The direction of flow of the coolant 13 is indicated by arrows in FIG. 1*a*.

Two outlet ports 18 are preferably arranged on either side respectively of a fuel injector 20 (shown in FIG. 6), which is intended to be arranged in a recess 21 formed in the cylinder head 2. Cooling of the fuel injectors 20 is thereby achieved. One fuel injector 20 is preferably provided for each cylinder 8. It is possible to provide more than one inlet port 11 per cylinder 8 and more than two outlet ports 18 per cylinder 8. For example, four outlet ports 18 per cylinder 8 may be provided as shown in FIG. 1*a*. It is also possible to provide only one outlet port 18 per cylinder 8.

Figure 1B:
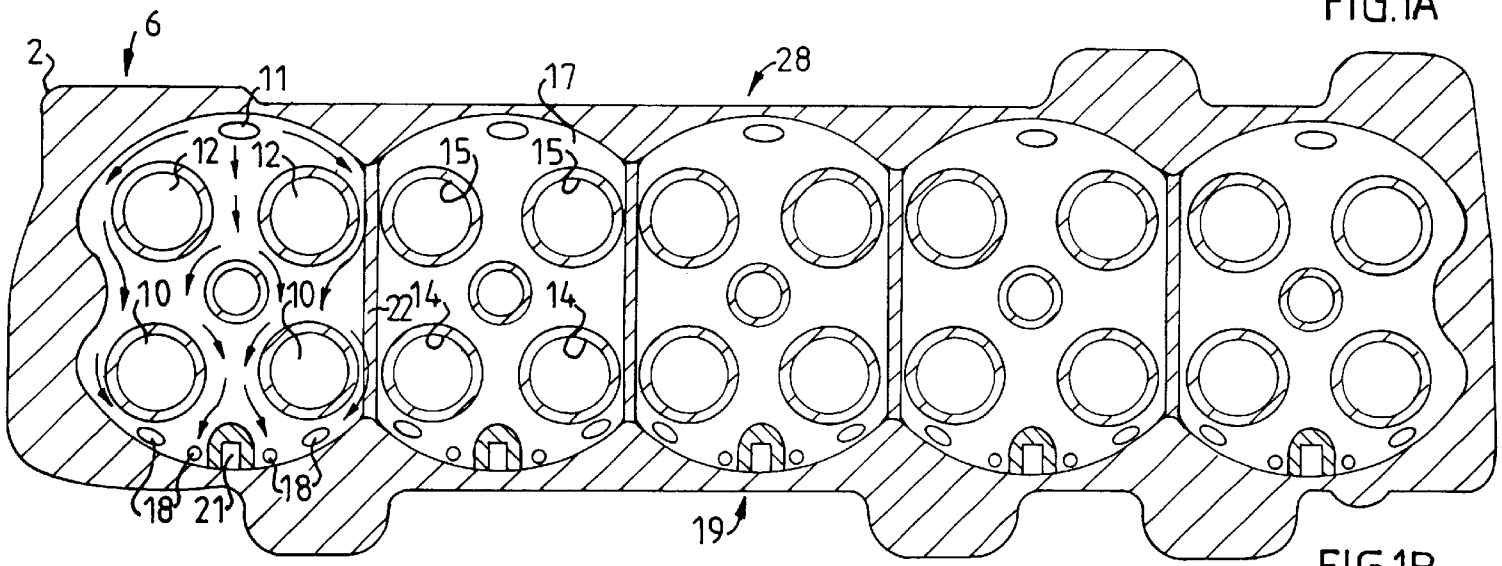
FIG. 1*b* shows a cylinder head according to a second embodiment of the present invention.

According to a second embodiment of the invention, shown in FIG. 1*b*, the second coolant space 17 in the cylinder head 2 is provided with partition walls 22. This ensures a uniform cooling of all fuel injectors 20 and the exhaust valve seats 15 along the entire cylinder head 2. The partition walls 22 also help to improve the strength of the cylinder head 2 and to increase the pressure on the cylinder head gasket 4, thereby increasing the sealing capacity.

The cylinder head gasket 4 is provided with a plurality of holes 23 that act in association with the inlet and outlet ports 11, 18 in the cylinder head 2. The holes 23 are substantially equal in area, but it is possible to provide the holes 23 with different areas in order to adjust the coolant flow in the inlet and outlet ports 11, 18 so that all cylinders 8 receive uniform cooling.

FIG. 3 shows slits 24 formed in a partition wall 25 that is arranged between each adjoining cylinder 8. The width of the slits 24 is approximately 1 mm and they have a depth of approximately 20 mm. The purpose of the slits 24 is to relieve the cylinders 8 and cylinder liners 26 arranged in the cylinders 8 of stresses in the longitudinal direction of the internal combustion engine 6, which stresses occur, among other things, due to the heat developed in the internal combustion engine 6. If the stresses become too great, the cylinders 8 and the liners 26 may be deformed and become unround, which leads, among other things, to increased friction between piston (not shown) and liner 26, and to increased oil consumption, which leads to increased emissions.

Deformation of the cylinders 8 and the liners 26 also leads to gas leakage between piston and liner 26, so-called "blow by" and also to increased vibrations and power losses. In order to further reduce the thermal stresses in the cylinders 8 and the liners 26, the coolant 13 is conveyed through the slits 24. The flow of coolant 13 through the slits 24 thus contributes to cooling of the cylinders 8 and the liners 26 which reduces the liner deformation.

FIG. 3 also shows how two restriction elements 27 are arranged in the first coolant space 16 in the cylinder block 1. The restriction elements 27 are located at each end of the engine 6, at cylinder I and cylinder V. The restriction elements 27 may consist of a unit arranged in the first coolant space 16, but may also consist of a unit integrally cast with the cylinder block 1. The purpose of the restriction elements 27 is to restrict the coolant flow to flowing from the exhaust side 28 to the intake side 19 in the first coolant space 16 in the cylinder block 1. A restricted volumetric flow, however, must be allowed to pass the restriction elements 27 in the direction of the intake side 19. The restriction elements 27 also force the coolant 13 to flow into the slits 24 toward the intake side 19. This direction of flow is achieved in that an inlet opening 29 for the coolant 13 is arranged in the exhaust side 28 of the cylinder block 1 and an outlet opening 30 for the coolant 13 is arranged in the intake side 19 of the cylinder block 1. Intake side 19 is here taken to mean that side of the cylinders 8 on which the intake valves 10 are situated, and exhaust side 28 is taken to mean that side of the cylinders 8 on which the exhaust valves 12 are situated. The restriction elements 27 ensure that the main coolant flow will flow through the inlet ports 11 to the second coolant space 17 in the cylinder head 2 and on through the outlet ports 18 back to the exhaust side 28 of the first coolant space 16, to then leave the first coolant space 16 through the outlet opening 30 in the cylinder block 1. The main coolant flow is here taken to mean at least 75% of the flow. The restriction elements 27 must preferably guide at least 90% of the coolant flow through the inlet ports 11 in the cylinder head 2. The restriction elements 27 may also be designed and located so that flow ratios other than that indicated above can be obtained.

Figure 4:
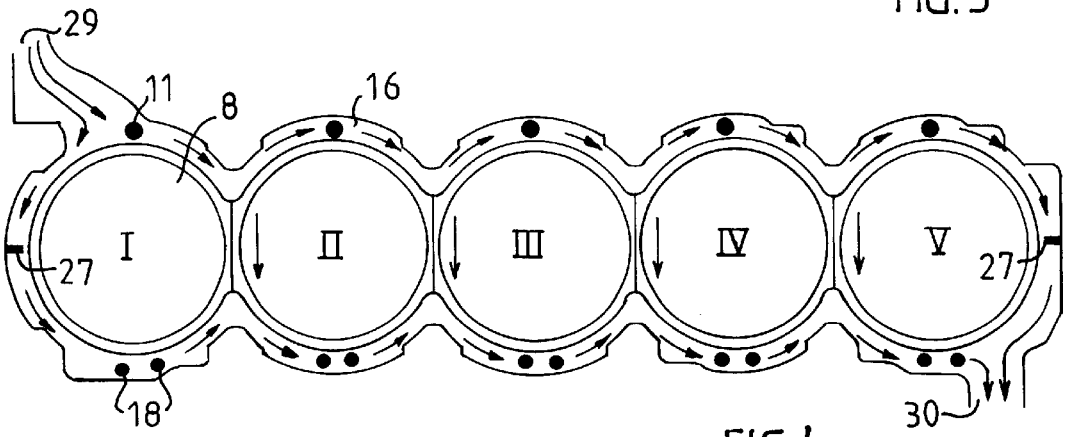
FIG. 4 shows a diagrammatic sketch indicating how coolant flows in an internal combustion engine according to the present invention.

FIG. 4 shows a diagrammatic sketch indicating how coolant 13 under pressure flows into the cylinder block 1 through the inlet opening 29 on the exhaust side 28. The pressure is generated by a coolant pump (not shown). The inlet opening 29 is situated at cylinder number 1, but may also be arranged at any of the cylinders number II–V. The coolant 13 flows from cylinder number I and on towards cylinder number V. A restricted coolant flow bypasses the restriction elements 27 and passes through the slits 24, with the main coolant flow flowing through the inlet ports 11 in the cylinder head 2 and back through the outlet ports 18 in the cylinder head 2 to the first coolant space 16 in the cylinder block 1. Thus the main coolant flow, which flows on the intake side 19 of the cylinder block 1, will derive from the coolant 13, which passed the second coolant space 17 in the cylinder, head 2. Finally, the coolant 13 flows out through the outlet opening 30 in the cylinder block 1. In FIG. 4, the outlet opening 30 is located at cylinder number V, but it may also be located at any of the cylinders number II–V. FIG. 4 shows only two outlet ports 18 per cylinder.

Figure 5:
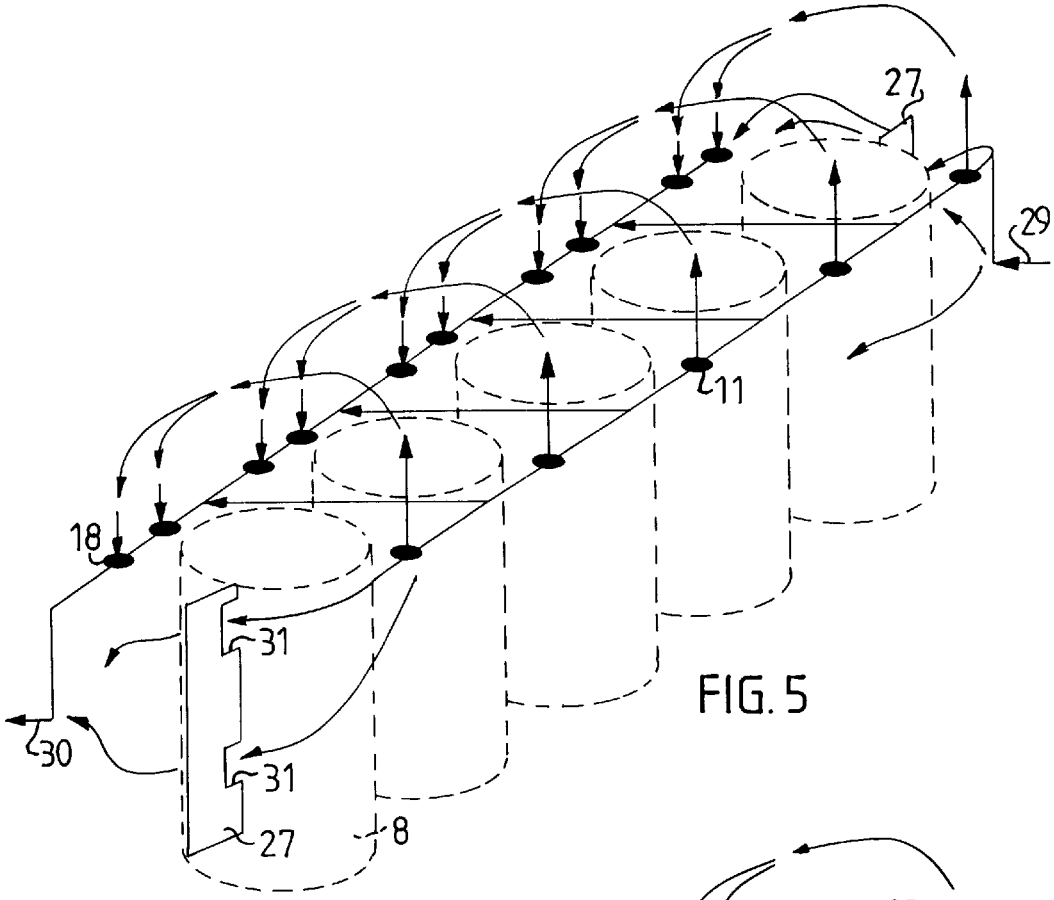
FIG. 5 shows a diagrammatic sketch giving a perspective view of how coolant flows lows in an internal combustion engine according to the present invention.

FIG. 5 shows a diagrammatic sketch giving a perspective view of how coolant 13 flows in an internal combustion engine 6 according to the invention. It will be seen from the Figure how the coolant 13 passes upward through the inlet ports 11 to the cylinder head 2 and then downward through the outlet ports 18 back to the cylinder block 1. It will be seen how the restriction elements 27 may be designed with a notch 31, which allows the coolant 13 to bypass the restriction elements 27.

Figure 6:
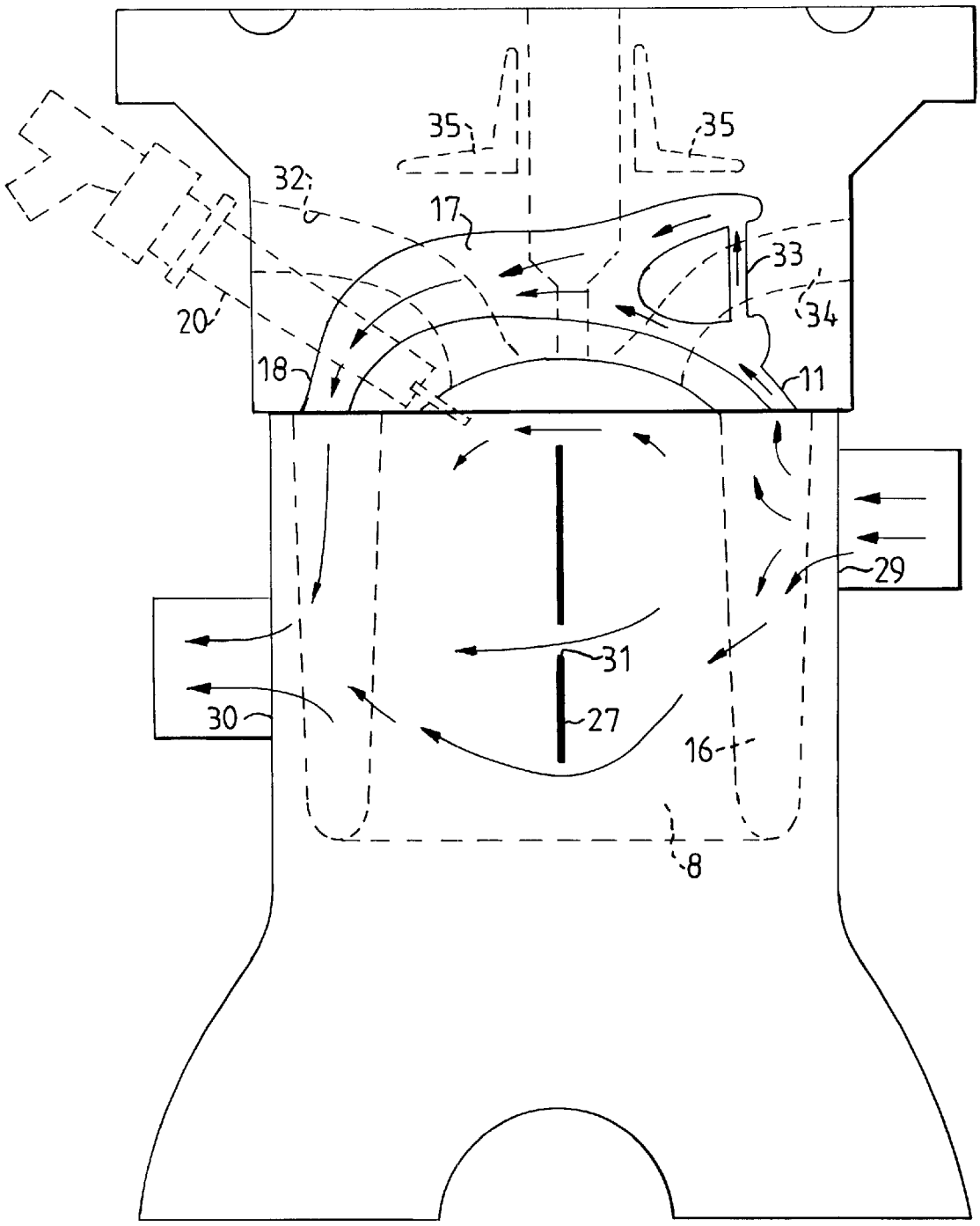
FIG. 6 shows a side view of how coolant flows in an internal combustion engine according to the present invention.

FIG. 6 shows a side view of the internal combustion engine 6 according to the invention. A fuel injector 20 arranged in the cylinder head 2 extends through the cylinder head 2 and on to the cylinder 8. The fuel is thus injected directly into the cylinder 8. It is also possible, however, to arrange the fuel injector 20 so that fuel is injected into an intake port 32. The coolant 13 flows in through the inlet opening 29 in the cylinder block 1 and on up through the inlet ports 11 to the second coolant space 17 in the cylinder head 2. The inlet port 11 is preferably arranged to extend between two exhaust valve seats 15. In this way cooling of the exhaust valve seats 15 is obtained. A bore 33 in the cylinder head 2 conveys the coolant 13 upward between two exhaust ports 34 so that the second coolant space 17 in the cylinder head 2 will extend up to oil covers 35 arranged in the cylinder head 2, in which covers lubricating oil for the engine 6 is stored. Cooling of the lubricating oil in the oil covers 35 is thereby achieved. The coolant 13, which passed the bore 33 and the inlet port 11, then flows on towards the outlet ports 18, which extend up to and adjoin the fuel injector 20. In this way the fuel injector 20 and electronics (not shown) arranged in the fuel injector 20 are cooled. It is also possible for just one outlet port 18 to extend up to the fuel injector 20.

Figure 7:
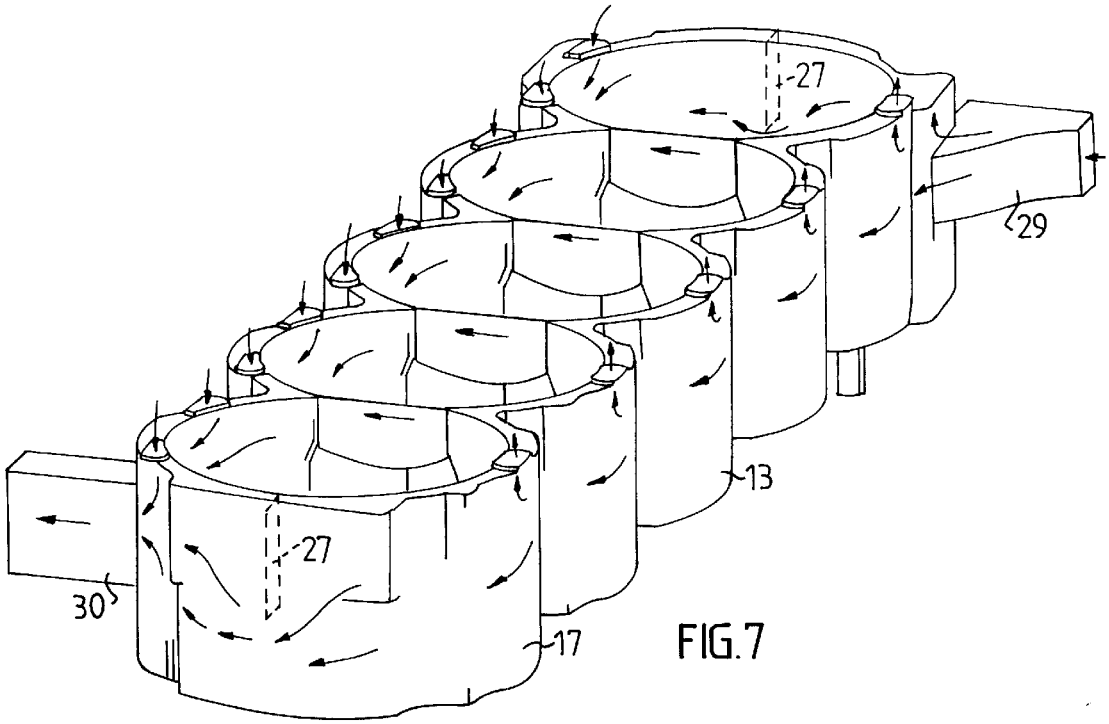
FIG. 7 shows a diagrammatic perspective view of the distribution of the coolant in the cylinder block of an internal combustion engine according to the present invention.

FIG. 7 shows a diagrammatic perspective view of the distribution of the coolant 13 in the first coolant space 16 in the cylinder block 1. The coolant 13 surrounds each cylinder 8. The restriction elements 27 are indicated at each end of the coolant space 16. The restriction elements 27 may be designed so that a restricted volumetric flow passes under these, as shown in FIG. 7. The restriction elements 27 may be located differently and have a different length so that uniform cooling of all cylinders 8 is achieved.

Figure 8:
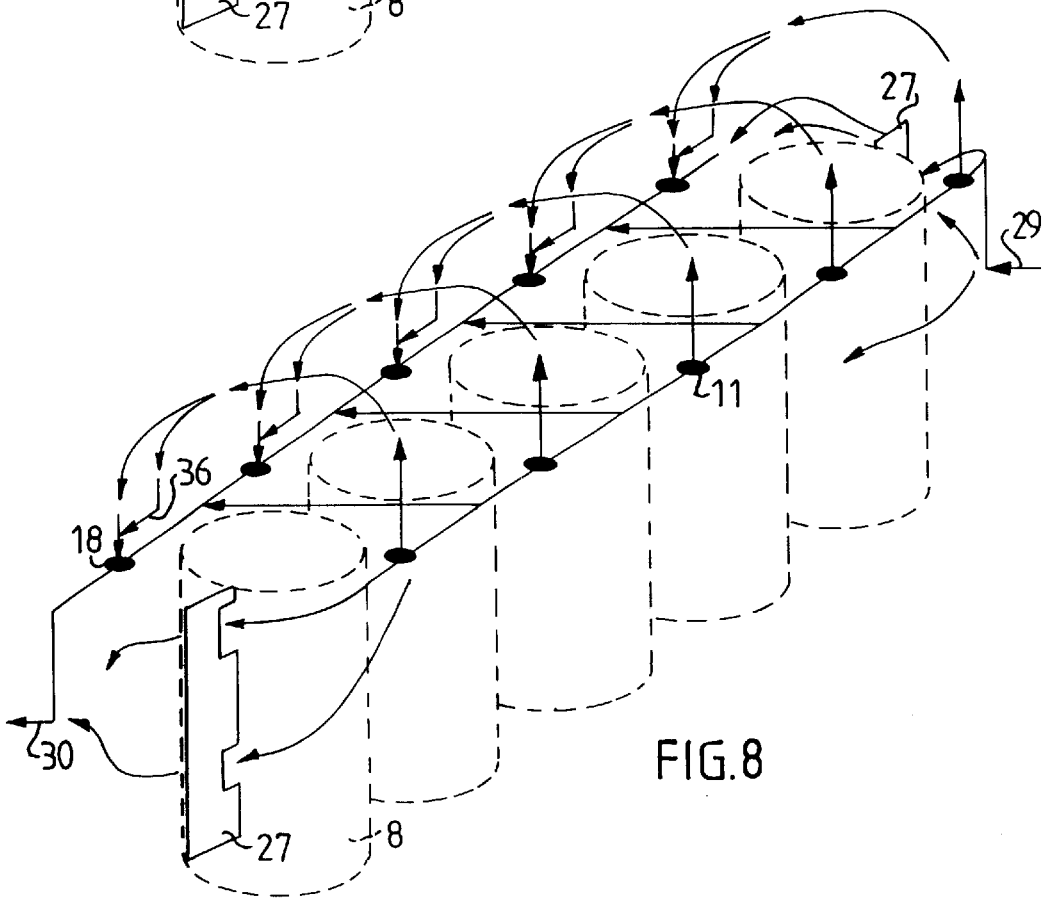
FIG. 8 shows a diagrammatic sketch giving a perspective view of how, according to an alternative example of an embodiment, coolant flows in an internal combustion engine according to the present invention.

According to an alternative embodiment, as shown diagrammatically in FIG. 8, grooves or lateral ports 36 may be incorporated in the cylinder head 2, which grooves or ports convey coolant 13 in the longitudinal direction of the engine 6. The grooves or lateral ports 36 may connect the outlet ports 18, which extend on either side of the fuel injectors 20, and bring the outlet ports 18 together into one port, which extends through the cylinder head gasket 4. In this way fewer holes 23 can be made in the cylinder head gasket 4. It is also possible to connect all outlet ports 18 for each cylinder 8 to one another. The number of holes 23 in the cylinder head gasket 4 can thereby be reduced to just one hole 23.

In the embodiment according to the figures, a five-cylinder in-line engine is shown. The cooling system according to the invention may, however, be applied to any internal combustion engine of piston type, such as a V-engine. The internal combustion engine may also be of the so-called "open deck" type or "closed deck" type, both with so-called wet liners and with dry liners, and also of the monobloc type. It is also possible to reverse the direction of flow of the coolant 13, so that the coolant 13 enters the cylinder head 2 through the outlet ports 18 on the intake side 19 and leaves the cylinder head 2 through the inlet ports 11 on the exhaust side 28.

An internal combustion engine with a unique cooling arrangement, and its components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

What is claimed and desired to be secured by Letters Patent is as follows:

1. An internal combustion engine comprising:

a cylinder block with at least two cylinders and at least one intake and exhaust valve per cylinder;

a cooling system having an inlet opening formed in the cylinder block and leading to a first coolant space in the cylinder block;

at least one restriction element arranged in the first coolant space;

a second coolant space in a cylinder head and inlet ports arranged in the cylinder head and connecting the first and second coolant spaces to one another, the inlet ports being principally situated on an exhaust side of the cylinder head;

outlet ports arranged in the cylinder head and connecting the first and second coolant spaces one another, the outlet ports being principally arranged on an intake side of the cylinder head; and an outlet opening formed in the cylinder block, the outlet opening having a connection to the first coolant space;

wherein the at least two cylinders are arranged along side one another and a slit is arranged between the cylinders connecting the exhaust side of the first coolant space to its intake side.

2. The internal combustion engine as recited in claim 1, wherein the at least one restriction element is arranged in the first coolant space so that the restriction element guides a main part of the coolant flow to the second coolant space in the cylinder head.

3. The internal combustion engine as recited in claim 1, wherein a restriction element is arranged at each end of the internal combustion engine.

4. The internal combustion engine as recited in claim 1, wherein the second coolant space in the cylinder head is provided with a partition wall arranged between each cylinder.

5. The internal combustion engine as recited in claim 1, wherein a fuel injector is arranged in the cylinder head and at least one outlet port extends up to and adjoins the injector.

6. The internal combustion engine as recited in claim 5, wherein the at least one outlet port extends on either side of the injector.

7. The internal combustion engine as recited in claim 1, wherein a cylinder head gasket is arranged between the cylinder block and the cylinder head, the gasket having a plurality of holes that act in association with the inlet and outlet ports in the cylinder head.

8. An internal combustion engine comprising:

a cylinder block with at least one cylinder and at least one intake and exhaust valve per cylinder;

a cooling system comprising an inlet opening formed in the cylinder block and that leads to a first coolant space in the cylinder block;

at least one restriction element arranged in the first coolant space;

a second coolant space in a cylinder head, a fuel injector arranged in the cylinder head;

inlet ports arranged in the cylinder head which connect the first and second coolant spaces to one another, the inlet ports being principally situated on an exhaust side of the cylinder head;

outlet ports arranged in the cylinder head that connect the first and second coolant spaces to one another, the outlet ports being principally arranged on an intake side of the cylinder head, wherein at least one outlet port extends up to and adjoins the injector; and an outlet opening formed in the cylinder block, the outlet opening having a connection to the first coolant space.

* * * * *